US008536430B2

(12) United States Patent
McCabe et al.

(10) Patent No.: US 8,536,430 B2
(45) Date of Patent: Sep. 17, 2013

(54) FINE TUNING MEANS FOR FULCRUM TREMOLO

(76) Inventors: Geoffrey McCabe, Hollywood, CA (US); Gary Kahler, Oceanside, CA (US)

( * ) Notice: Subject to any disclaimer, the term of this patent is extended or adjusted under 35 U.S.C. 154(b) by 521 days.

(21) Appl. No.: 12/686,968

(22) Filed: Jan. 13, 2010

(65) Prior Publication Data

US 2010/0175534 A1 Jul. 15, 2010

Related U.S. Application Data

(60) Provisional application No. 61/205,023, filed on Jan. 14, 2009.

(51) Int. Cl.
*G10D 3/00* (2006.01)

(52) U.S. Cl.
USPC ..... 84/312 R; 84/313

(58) Field of Classification Search
USPC ..... 84/312 R
See application file for complete search history.

(56) References Cited

U.S. PATENT DOCUMENTS

| | | | |
|---|---|---|---|
| 1,475,345 | A | 11/1923 | Lambert et al. |
| 2,191,776 | A | 2/1940 | Schreiber |
| 2,976,755 | A | 3/1961 | Fender |
| 3,313,196 | A | 4/1967 | Mari |
| 3,407,696 | A | 10/1968 | Smith et al. |
| 3,599,524 | A | 8/1971 | Jones |
| 3,678,795 | A | 7/1972 | Fullerton |
| 3,763,736 | A | 10/1973 | Williams |
| 3,911,777 | A | 10/1975 | Rendell |
| 3,911,778 | A | 10/1975 | Martin |
| 4,027,570 | A | 6/1977 | Rendell et al. |
| 4,037,506 | A | 7/1977 | How |
| 4,111,093 | A | 9/1978 | Field et al. |
| 4,135,426 | A | 1/1979 | Richard |
| 4,142,435 | A | 3/1979 | Pozar |
| 4,171,661 | A | 10/1979 | Rose |
| 4,201,108 | A | 5/1980 | Bunker |
| 4,206,679 | A | 6/1980 | Wilson |
| 4,208,941 | A | 6/1980 | Wechter |
| 4,241,637 | A | 12/1980 | Brent |
| 4,283,982 | A | 8/1981 | Armstrong |
| 4,304,163 | A | 12/1981 | Siminoff |
| 4,348,934 | A | 9/1982 | Ogata |
| 4,389,917 | A | 6/1983 | Tiebout, III |

(Continued)

*Primary Examiner* — Christopher Uhlir
(74) *Attorney, Agent, or Firm* — San Diego IP Law Group, LLC

(57) ABSTRACT

Apparatus, such as a stringed musical instrument, is provided with intonation modules that include a novel fine-tuning invention that eliminates modifying strings required of prior art comprising an improved clamping element, a hollow tube element forming a tailpiece at one end furthest the second critical point and a novel adaptor plate element connected to a base plate. Clamping the sting renders the string substantially inextensible between the clamping point and the tailpiece formed at the end of the hollow. Threading the string through the hollow tube portion delivers the string over the second critical point effortlessly. The hollow portion of the string holder element is threadedly engaged with an adjustment knob and makes bearing contact with adaptor plate for fine-tuning. The adaptor plate can be added to a unitary component forming the base plate and can provide other functions. Reverse threaded screws intonation module attachment screws are provided to complete a comprehensive base plate/intonation module format that integrates to a common standard all elements of the two otherwise disparate two primary vintage fulcrum tremolo designs except for riser post spacing. An improved ball bearing arrangement is also disclosed.

16 Claims, 5 Drawing Sheets

(56) References Cited

U.S. PATENT DOCUMENTS

| | | | | | |
|---|---|---|---|---|---|
| 4,425,831 | A | | 1/1984 | Lipman | |
| 4,433,603 | A | | 2/1984 | Siminoff | |
| 4,457,201 | A | | 7/1984 | Storey | |
| 4,462,295 | A | | 7/1984 | Hundley | |
| 4,475,432 | A | | 10/1984 | Stroh | |
| 4,497,236 | A | | 2/1985 | Rose | |
| 4,522,101 | A | | 6/1985 | Peavey et al. | |
| 4,549,461 | A | | 10/1985 | Rose | |
| 4,555,970 | A | | 12/1985 | Rose | |
| 4,573,391 | A | | 3/1986 | White | |
| 4,608,904 | A | | 9/1986 | Steinberger | |
| 4,608,905 | A | * | 9/1986 | Takabayashi | 84/313 |
| 4,608,906 | A | * | 9/1986 | Takabayashi | 84/313 |
| 4,608,908 | A | | 9/1986 | Carlson et al. | |
| 4,632,005 | A | | 12/1986 | Steinberger | |
| 4,638,708 | A | | 1/1987 | Kamal | |
| 4,638,711 | A | | 1/1987 | Stroh | |
| 4,648,304 | A | | 3/1987 | Hoshino et al. | |
| 4,656,915 | A | | 4/1987 | Osuga | |
| 4,674,369 | A | | 6/1987 | Gutohrlein et al. | |
| 4,677,891 | A | | 7/1987 | Gressett, Jr. et al. | |
| 4,681,011 | A | | 7/1987 | Hoshino | |
| 4,690,027 | A | | 9/1987 | Ido | |
| 4,696,218 | A | | 9/1987 | Hoshino et al. | |
| 4,712,463 | A | | 12/1987 | Kubicki et al. | |
| 4,724,737 | A | | 2/1988 | Fender | |
| 4,768,415 | A | | 9/1988 | Gressett, Jr. et al. | |
| 4,779,508 | A | | 10/1988 | Beals | |
| 4,793,238 | A | | 12/1988 | Budzich | |
| 4,803,906 | A | | 2/1989 | Fender | |
| 4,840,102 | A | | 6/1989 | Pittman | |
| 4,843,941 | A | * | 7/1989 | Nichols et al. | 83/313 |
| 4,854,210 | A | | 8/1989 | Palazzolo | |
| 4,882,967 | A | | 11/1989 | Rose | |
| 4,903,568 | A | * | 2/1990 | Itoh | 84/313 |
| 4,905,583 | A | | 3/1990 | Hayashi | |
| 4,939,970 | A | | 7/1990 | Hosino et al. | |
| 4,945,801 | A | | 8/1990 | Stroh et al. | |
| 4,967,631 | A | * | 11/1990 | Rose | 84/313 |
| 4,982,640 | A | | 1/1991 | Buscarino | |
| 5,011,581 | A | | 4/1991 | Omata et al. | |
| 5,012,716 | A | | 5/1991 | Pagelli | |
| 5,033,353 | A | | 7/1991 | Fata et al. | |
| 5,052,269 | A | | 10/1991 | Young et al. | |
| 5,072,646 | A | | 12/1991 | Valkama | |
| 5,097,737 | A | | 3/1992 | Uhrig | |
| 5,125,311 | A | | 6/1992 | Boulanger et al. | |
| 5,136,918 | A | | 8/1992 | Ribiloff | |
| 5,140,884 | A | | 8/1992 | Bowden | |
| 5,191,159 | A | | 3/1993 | Jordan | |
| 5,198,601 | A | | 3/1993 | McCabe | |
| 5,227,571 | A | | 7/1993 | Cipriani | |
| 5,265,512 | A | | 11/1993 | Kubicki et al. | |
| 5,277,095 | A | | 1/1994 | Steinberger | |
| 5,295,427 | A | | 3/1994 | Johnsen et al. | |
| 5,337,643 | A | | 8/1994 | Cantrell | |
| 5,343,793 | A | | 9/1994 | Pattie | |
| 5,347,904 | A | | 9/1994 | Lawrence | |
| 5,347,905 | A | | 9/1994 | Cipriani | |
| 5,353,672 | A | | 10/1994 | Stewart | |
| 5,359,144 | A | * | 10/1994 | Benson | 84/313 |
| 5,361,667 | A | | 11/1994 | Pritchard | |
| 5,372,057 | A | | 12/1994 | Hart | |
| 5,390,578 | A | | 2/1995 | Raymer | |
| 5,398,581 | A | | 3/1995 | Castillo | |
| 5,410,936 | A | | 5/1995 | Ellsworth et al. | |
| 5,413,019 | A | | 5/1995 | Blanda, Jr. | |
| 5,519,168 | A | | 5/1995 | Gregory | |
| 5,421,233 | A | | 6/1995 | Bunker | |
| 5,438,901 | A | | 8/1995 | Sperzel | |
| 5,452,637 | A | | 9/1995 | DeCola | |
| 5,458,035 | A | | 10/1995 | Okamura | |
| 5,477,764 | A | | 12/1995 | Carrico | |
| 5,522,299 | A | | 6/1996 | Rose | |
| 5,537,907 | A | | 7/1996 | Rose | |
| 5,539,143 | A | | 7/1996 | Rose | |
| 5,549,027 | A | | 8/1996 | Steinberger et al. | |
| 5,567,903 | A | | 10/1996 | Coopersmith et al. | |
| 5,589,653 | A | | 12/1996 | Rose | |
| 5,600,078 | A | | 2/1997 | Edwards | |
| 5,614,688 | A | | 3/1997 | Donnell | |
| 5,631,432 | A | | 5/1997 | Muncy | |
| 5,637,818 | A | | 6/1997 | Fishman et al. | |
| 5,637,823 | A | | 6/1997 | Dodge | |
| 5,661,252 | A | | 8/1997 | Krawczak | |
| 5,672,835 | A | | 9/1997 | Doughty | |
| 5,679,910 | A | | 10/1997 | Steinberger et al. | |
| 5,684,256 | A | | 11/1997 | Rose | |
| 5,689,057 | A | | 11/1997 | Rose | |
| 5,689,075 | A | | 11/1997 | Rose | |
| 5,696,335 | A | | 12/1997 | Rose | |
| 5,717,150 | A | | 2/1998 | Rose | |
| 5,739,444 | A | | 4/1998 | Borisoff | |
| 5,880,383 | A | * | 3/1999 | Huff | 84/313 |
| 5,945,615 | A | | 8/1999 | Rose | |
| 5,986,191 | A | * | 11/1999 | McCabe | 84/313 |
| 6,046,393 | A | | 4/2000 | Rose | |
| 6,046,397 | A | | 4/2000 | Rose | |
| 6,051,773 | A | | 4/2000 | Rose | |
| 6,111,176 | A | | 8/2000 | Rose | |
| 6,137,039 | A | | 10/2000 | Rose | |
| 6,194,645 | B1 | | 2/2001 | Rose | |
| 6,198,030 | B1 | | 3/2001 | Rose | |
| 6,563,034 | B2 | * | 5/2003 | McCabe | 84/312 R |
| 6,919,501 | B2 | * | 7/2005 | Burton | 84/313 |

* cited by examiner 10
11
12
13
14
27/29
33
35
36
39
41
42
43
44
45
53
55
56

10
45°
12
14
17
20
21
23
24
25
27
28
29
30
31
32
33
34
35
36
37
38
39
41
43
44
46
47
48
49
50
51
52
53
55
57

FINE TUNING MEANS FOR FULCRUM TREMOLO

We, Geoffrey McCabe and Gary Kahler, claim priority to the earlier filed USPTO Provisional Application No. 61/205,023 filed Jan. 14, 2009 for collaborative improvements to the fulcrum tremolo.

BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. Further, it is known to those of ordinary skill in the art that the direction of the strings are generally parallel to both neck and the surface of the body despite instances where the string deviates from this direction at either or both the peg head or tailpiece. The tension of an individual guitar string is approximately 17 lbs at typical pitched conditions; anchoring or securely attaching the string holds the string to the instrument under normal conditions that often comprise an additional 10 lbs of tension per string under other certain circumstances.

The second critical point can be created as a part of a combined bridge and tailpiece structure. Traditionally, the size of the bridge element is quite small so as to create a clearly defined single point of contact between the string and the bridge element. It is between these two points that the playable string length is typically determined, sometimes referred to as the scale length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to the "setup", it is not uncommon that further adjustment of the harmonic tuning is necessary for a variety of reasons, for example, including changing the brand of a string where the alloy of the strings is varied or when the gauge of strings the player chooses changes. The term "intonation module" herein is defined as a device, one for each string of a stringed musical instrument, as opposed to, say, the tremolo itself, comprising a bridge element forming a second critical point adjustably positioned relative to the body and relative to the nut or the first critical point for harmonic tuning, and includes one additional element, such as, for example, a tailpiece element for fixedly securing the associated string to the body, or an alternate tailpiece, or a string tuning element to pitch tune and/or adjust the tension of the associated string such as a macro-tuner or a fine-tuner or parts thereof. Intonation modules can include aspects such as a base, a front end or leading edge closer the nut, a rear edge or trailing edge further the nut, formed with recesses, restricted portions, hollow portions, etc., adjustably secured to a base plate that in some cases may comprise a tremolo in general or fulcrum tremolo in particular.

Often the typical construction of the strings, particularly for guitar and bass, includes a plain end and, on the other end, a "ball end" which being a washer-like addition is wrapped by the string itself into a larger form to help in "fixing" or securing the string on the instrument to the tailpiece. Alternatives to the traditional "ball-end" can include molded ends that are reminiscent of bullets in shape, Fender Musical Instruments sells strings with "bullet ends" and there are similar Floyd Rose Speedloader strings that include such variations on each end of the string. Accordingly, the term "ball-end" is used collectively herein defined to include both the traditional and/or novel end of strings, opposite the "plain" end, meant for attaching to the tailpiece element of the instrument. The tailpiece provides for an opening or recess sufficient in size to receive the strings of various diameters generally ranging from 0.007" to 0.070" or more while being smaller than the diameter of the ball end so as to limit the passing of the ball end through the opening or recess in order to secure or mount the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. Stable fine adjustments of these and other elements have been a longstanding problem for stringed musical instruments.

In the relevant art, "anchoring" strings is often referred to as attaching or securing a string and understood with the limitation that the anchoring is sufficient so that the string is fixedly attached or secured to the instrument under the typical tensioned conditions of the string.

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, an interval falling between that of a whole tone and a minor third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146, shows and provides a device comprising a novel structure which incorporates the bridge and the tailpiece. The portion supporting the bridge elements is called the bridge plate or the base plate. Further, the both the bridge and the tailpiece elements connected to the base plate simultaneously move together as the fulcrum tremolo device is pivoted around the pivot axis. Accordingly, a singular and defining aspect of the fulcrum tremolo is that the harmonic tuning is upset as the device is pivoted; and, accordingly, for an instrument equipped with a fulcrum tremolo, restoring any or all of the strings to a proper pitched condition also simultaneously restores the harmonic tuning. The base plate upon which the individual bridge elements are adjustably secured has a beveled ridge portion which is secured to the instrument body by six screws permitting pivotal movement about a fulcrum axis which varies the tension on the strings and produces the desired tremolo effect.

In this first vintage system, herein referred to as Type I, the metal bridge elements of '146 are loosely held in place by a spring loaded attachment screw arrangement pivotally secured through openings in a small bent portion of the base plate farthest from the fulcrum axis. The bridge elements also incorporate setscrews for varying the relative height of the bridge elements and, therefore, height of the respective second critical points relative to the base plate and by extension, the body and neck. Later iterations of Fender '146 included pivotally supporting the fulcrum tremolo relative to the body by a riser posts arrangement adjustably connected to the fulcrum tremolo. The horizontal distance between the vertical centerline of each riser post is approximately 2.22". Further, the distance from the pivot point to the second critical point not including the variable heights of the bridge elements is 0.25" and the distance form the nut to the pivot is about 25.25" since the Fender Stratocaster for which this fulcrum tremolo first appeared provided a 25.5" scale length.

Typically, in order to facilitate the fulcrum tremolo pivoting about its fulcrum axis, counter springs are utilized to counteract or counter balance the pull of the strings. Counter springs are usually connected to the body of the instrument at one end and, on the other end, to a separate spring attachment means usually a block of metal, milled or cast or a combination of the two, which being secured to the bottom of the base plate by three screws 90 degrees to the base plate is often called a spring block. Upward pitch changes initiated by the use of the fulcrum tremolo in one direction can increase the tension of individual strings over the normal 17 pounds.

One of the most troublesome problems with prior art has been maintaining the initial tuning at proper playing pitch. When a musician plays on the string there is usually some kind of string stretch over time that results in the overall tuning going out of balance. Specifically, when the pitch of the string changes, the position of the fulcrum tremolo and the position of the second critical point relative to the nut changes which then alters the harmonic tuning.

Initial position refers to the specific equilibrium point between the tension of the strings and the tension of the counter springs at the intended tuned pitched condition of the strings when harmonic tuning is achieved. Often the pivot means is subject to wear and the tremolo does not always return to its initial position. Great care is required to establish an initial position that provides both the proper harmonic tuning and proper pitch tuning for each of the individual strings since both aspects of adjustment are interactive.

Improvements to the Fender '146 fulcrum tremolo have included using string clamps at the nut and at point on the opposite side of the intonation point or second critical point on each of the bridge elements relative to the nut in order to limit string stretch to the portion of the string within these two points defining the scale length; and, separately, adopting a novel shaped beveled edge, called a "knife edge", adjustably supported by two screw-like members called riser posts positioned in the body to improve the return to initial position after pivoting the fulcrum tremolo device (Rose U.S. Pat. No. 4,171,661). The knife edge fulcrum arrangement provides for the base plate to be positioned generally parallel to the instrument body and offers the novel possibility to increase the tension of the string for upward pitch changes; this feature can increase string tension well beyond the normal approximate 17 lbs of tension at typical playing pitches.

In this second vintage system, herein referred to as Type II, the horizontal distance between the vertical centerline of each riser post is approximately 2.925". The distance from the pivot point to the second critical point, not compensating for the variable heights of the bridge elements, is 0.50" and approximately 25.00" from the first critical point on the nut for instruments with a 25.5" scale length. This greater distance of 0.50" relative to Fender's 0.25" provides an additional area on the leading edge portion of the base plate, the area located closest to the nut. The Rose assembly bridge-tailpiece extra portion then includes a fork-like slot arrangement extending between the bridge portion and the leading edge of the base plate. An attachment screw is positioned within the fork-like slot for threadedly attaching the Rose improvement to the base plate. Accordingly, sliding the fork-like portion and, therefore, the Rose assembly in the direction of the string adjusts the harmonic tuning of the string.

In Rose U.S. Pat. No. 4,497,236 a combination of the bridge element, the tailpiece and tuners replaced the "novel structure" of the Fender device so that within the limited range (typically within a range about the interval of a whole tone, for example from C to D in the Western diatonic musical scale) the strings could be re-tuned without first unlocking the string clamps at the nut. However, string stretch beyond the range of the fine tuners necessitated a correction that is tedious and time consuming involving unlocking the string clamps, re-tuning the strings, re-clamping, and further re-tuning the string with the fine tuners and then re-tuning all the other strings to re-balance the equilibrium point back to initial position. The string clamps of the Rose fulcrum tremolo comprise a conditional tailpiece and are characterized by small blocks slideably mounted within a recess within a housing element connected to the bridge element. The player, as a first step, typically cuts the ball-end of the string off, and then, in a second step, places the cut end of the string vertically or transverse the body within the recess between the block and a vertical surface located closest to the bridge element, then, in a third step, tightens an adjustment bolt against the block to, thereby, fixedly secure the string to the intonation module to create the functioning tailpiece, in a fourth step bends the remaining portion of the string approximately 90 degrees over the bridge, in a fifth and sixth step, secures the free end of the string to the tuning pegs for tensioning the string to proper playing pitch—in a some instances, there are later designs that while they do not require the ball end to be cut off for the clamping mechanism to fixedly secure a string, nonetheless show a design that requires the approximate 90 degree bend proximate the bridge element.

Each block is adjustably secured by an adjustment bolt aligned in the direction of the strings—threading the adjustment bolt slideably positions the block against the plain string end and clamps the string end between the block and a vertical surface of the recess in housing element. A first portion is formed parallel the instrument body that is the functional equivalent of the base plate of Fender '146 for securing the bridge elements. Adjustment bolts, one for each block, extend through slots formed in a second portion of the base plate fashioned to be simultaneously rising away from the body and nut at an angle. The second portion includes fine tuner screws threadably positioned transverse the direction of the strings that make variable contact with the adjustment bolt. Threading the fine tuner screw collectively pivots the position of the block and the housing element connected to the bridge portion as well as the bridge portion and the adjustment bolt about a separate axis parallel to the fulcrum axis for fine tuning the tension of the string.

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender U.S. Pat. No. 2,741,146, when pivoted:

Both the bridge portions and the string anchoring means, the tailpiece, simultaneously move about a fulcrum axis;

The harmonic tuning is upset; and

Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

The bridge and tailpiece portions simultaneously move about the fulcrum axis when the device is pivoted for the tremolo effect;

The fine tuner screws simultaneously move with the bridge and tailpiece portions about the tuning axis when fine tuning; and Fine tuners are designed to offer the tuning of the strings a minor adjustment of pitch after the general tuning is first achieved, typically, by the tuning pegs on the head of the instrument; and Adjusting the tension of a string by the fine tuner knob alone simultaneously adjusts the harmonic and pitch tuning and can achieve tuning a string to proper pitch conditions while simultaneously achieving proper harmonic tuning.

For those fulcrum tremolos fitted with string clamps at the first and second critical points as in Rose U.S. Pat. No. 4,171,661, String stretch beyond the clamps at the first and second critical points is eliminated offering the most stability of tuning possible;

A plain end of the string is inserted between the bock and a vertical surface formed in a recess in the housing element and clamped by threading an adjustment bolt; the adjustment screw is pivotally positioned in the direction of the strings and the fine tuner adjustment screw is both transverse to the adjustment bolt and direction of the strings.

These two vintage fulcrum tremolos of the last century, Fender in the 50's and Rose in the 80's, are in part distinguished by the differing standards in the spacing between the riser posts, 2.22" and 2.925" respectively; and the relative distance between the riser posts and the first critical point on nut on the one side, 25.25" and 25.00", respectively, and, from an overview perspective, 0.25" and 0.50", respectively, from the pivot point to the second critical point on the bridge on the other.

The individual parts of the two vintage designs were generally not compatible. Consequently, those who had guitars with the 2.925" spacing were limited to tremolos that had fine tuner arrangements and string locks and those guitars with the 2.22" spacing were limited to those tremolos without fine-tuners and string locks.

Further improvements in the fulcrum tremolo in the 90's and into the new millennium utilized various novel arrangements for pivoting that included at least a portion of the surface of a ball bearing at the pivot point adjustably mounted to the body which not only improved return to initial position after use of the tremolo but also virtually eliminated the wear and tear associated with prior art (McCabe U.S. Pat. Nos. 5,965,831, 5,986,191, 6,175,066, 6,563,034, 6,891,094 and 7,470,841).

The evolution from fine tuners to macro-tuners on a fulcrum tremolo (McCabe U.S. Pat. Nos. 5,965,831, 5,986,191, 6,175,066, 6,563,034, 6,891,094 and 7,470,841) provided an intonation module that included a novel integrated bridge-tailpiece structure secured to the base plate of a fulcrum tremolo wherein the improvement included the broad provision to bring and adjust the strings to playing pitch from an untensioned condition circumventing the re-tuning limits imposed by the Rose clamps. Further distinguishing the art, various improvements positioned between the second critical point and the tailpiece portion are provided so the length of the string between these two areas is substantially inextensible in each of the macro-tuner examples. In each case the improvement comprised a novel portion that is positioned in a creative position for limiting the stretch of the string as outlined above while allowing the adjustment knob to be threaded to achieve macro-tuning '094 presents a novel quick tuning macro-tuner designed to bring each string to proper playing pitch in a first step and then further tuned by a separate fine tuner knob.

Macro-tuners refer to tuners with the capacity to raise and adjust the tension of the strings from an untensioned condition to a proper playing pitch, and as such provide for alternate tunings and compensation for substantial string stretch during the life of the string essentially without additional means.

Other improvements as disclosed in McCabe '831, '066, '094 and 191 included "tiers" or "steps" positioned on the base plate of the fulcrum tremolo, one for each bridge element or intonation module, that in displacing their relative positions create a radius for the strings in relationship to the radius of the fingerboard.

McCabe '034 discloses a modular fulcrum tremolo system with standardized base plate features available both the 2.925" spacing and 2.22" spacing where all the parts other than the base plate, such as the intonation modules solid or folded, with or with out macro-tuners, the global tuners, the tremolo arm assembly, etc. are interchangeable. Consequently, anyone can have simple intonation modules or macro-tuners regardless of the stud spacing and position present on the instrument.

McCabe '841 and '034 provide an unitary base plate formed, in one instance, by stamping and folding metal into a form that integrates the base plate with the spring block. Other features included bending a first portion of the base plate into a hinge-like form closest to the bearing axis creating a housing for receiving the bearings and/or the shaft for pivotally supporting the bearing assembly. Optionally, a cylinder for receiving the bearings can be fashioned for the same purpose and welded, for example, to the base plate in the same position. And in either case the dimensions of this portion reflects the spacing differences between the two vintage standards. Features also included "coining" a radius into the base plate, for example, in a series of steps or tiers to account for the radius of the fingerboard and eliminating the requirement of individual bridge element height adjustment screws so that the entirety of the bridge elements rest on the base plate maximizing acoustic coupling. "Coining" refers to that process in the stamping of metal that provides for a "relief" in the "landscape" of the object being formed.

SUMMARY OF THE INVENTION

Accordingly, a primary object of this invention is to provide improvements in the fine tuning/string locking mechanisms of the 80's vintage fulcrum tremolo that will allow a greater range of installation possibilities.

Improved Fine Tuner Mechanism

A primary object of the invention is to provide intonation modules comprising two separate but integrated improvements in a fine tuner mechanism: an improved clamping element and an improved fine-tuner element.

The intonation module comprises a base. A tuning element with an articulated interior portion pivotally connected to the base includes the bridge element. The tuning element further comprises an elongated portion. The elongated portion comprises a hollow tube-like portion, having a first end and a second end, aligned in the direction of the strings. A first end of the hollow tube is connected to the tuning element and is, therefore, also pivotally connected to the base; both the tuning element and hollow tube are formed to receive a string therethough. An essential novel aspect of the invention is that the hollow tube is fashioned in a form integrated with the interior portion of the tuning element so that the threading the string beginning at the second end is unencumbered passing through the hollow tube portion and upward through the interior of the base and over the bridge element. A second end of the hollow tube provides a tailpiece portion formed to hold the ball end of the string or similar and can include a flange, recess or similar structure to facilitate.

In the preferred embodiment a fine tuner plate fashioned with individual slots, one for each hollow tube as part of the intonation module and, therefore, each associated string, is connected to the base plate at approximately 45 degrees. The fine tuner plate can be fashioned from the fulcrum tremolo base plate or in the preferred embodiment formed separately and attached at the appropriate angle to the tremolo comprising, in a further preferred embodiment, an unitary base plate, for example. Alternately, individual fine tuner plates could be part of the individual intonation modules and comprise only one slot arranged to receive the associated hollow tube-like element or elongated member.

Care must be taken to fashion the fine tuner plate such that the portion comprising the slots does not interfere with the positioning of the intonation modules for harmonic tuning. Each one of the hollow tubes extends through one of each associated slots. A fine tuner knob is threadedly connected to the second end of the hollow tube, on the other side of the fine tuner plate from the bridge element and makes variable bearing contact with the fine tuner plate. Threading the fine tuner knob in the direction of the strings against the angled fine tuner plate pivotally positions the tuning element and, therefore, the tailpiece portion holding the ball end of the string for tensioning a string—the fine tuner knob simultaneously slides against the angled fine tuner plate. The fine tuner knob is fashioned with its own enlarged recess to receive the ball end sufficient in size so that the position of the ball end at the second end of the hollow tube is neither engaged nor disturbed by the threading of the fine tuner knob.

Improved Clamping Element

The improved clamping element comprises a clamping lever, and in the preferred embodiment, generally having an L-shape or profile comprising an upper leg and a lower leg. The articulated interior portion of tuning element further comprising an enlarged recess or oversized opening fashioned to adjustably receive the clamping lever. In one embodiment a clamping pin with an axis parallel to the fulcrum tremolo pivot axis adjustably secures the clamping lever within the oversized opening. The clamping lever is displaceable within the enlarged recess relative to the string diameter and in some embodiments around and about the clamping pin. A novel clamping screw arrangement transverse to the direction of the strings, positioned between the bridge portion and the hollow tube threadedly engages an upper portion of the tuning element making variable bearing contact with a lower leg portion of the clamping lever and clamps, along the axis of the string, to provide a clamping contact area between a lower portion of the tuning element and the lower leg of the clamp. Clamping the string by adjusting the clamping screw provides the force sufficient to secure the string's position at the clamping contact area at proper playing tension, and provide for a 100% anchoring or fixing of the string to the instrument that remains stable under the various tensions associated with the performance range of the fulcrum tremolo and establishes a second tailpiece. Clamping the string overrides the first tailpiece and transfers the tailpiece location from the second end of the hollow tube to the clamping portion. An upper leg portion of the clamping lever extends out of the recess and away from the base plate beyond the physical dimensions of the tuning element forming a safety release used to manually manipulate the clamping lever when not fixed by the clamping screw.

Clamping the string not only transfers the fixing or securing of the string from the second end of the hollow tube comprising a first tailpiece portion to the clamping point forming a second tailpiece portion but also simultaneously renders the string essentially inextensible between the clamping point and the second end of the hollow tube.

Also, critical to the design, the improved clamping element is formed so as to not impede the smooth threading of the string through the hollow tube portion or articulated interior portion when the clamp is not engaged.

Improved Bearing Arrangement

Another object of the invention is to include improvements to the bearing arrangement. In the one embodiment the bearings are spatially positioned, and in some cases by separate bearing spacers, within a bearing housing connected to the base plate; another embodiment positions a pair of bearings, a set on each side of the bearing housing. A bearing axel extends through the bearings in the housing supported on each end by a bearing axel housing. The bearing housing, bearing axel and bearing axel housing are essentially centered on and aligned to the fulcrum axis. Riser posts are threadedly connected to both the instrument body and the bearing arrangement. Threading the riser posts adjustably positions the axel and, therefore, the bearing portion and the fulcrum tremolo, relative to the instrument body. Another improvement comprises a setscrew, transverse the direction of the fulcrum axis, one for each bearing axel housing threadedly connected to the bearing axel housing. The setscrew is in variable bearing contact with the bearing axel within the bearing axel housing for additionally securing the axle to the axle housing. Threading the setscrew improves the alignment of the bearing axel housing to the bearing axel, bearings and bearing housings.

Improved Attachment Screw

Yet, another improvement comprises the use of a reverse threaded attachment screw for adjustably securing each intonation module to the base plate. For each intonation module there is an associated slot fashioned in the base plate in the direction of the strings through which a reverse threaded screw is positioned. Each intonation module comprises a reverse threaded recess or opening in the base and a "pin hole" in the tuning element for accessing the attachment screw. The reverse threaded screw is positioned within an associated slot with the head positioned on the side of the base plate furthest the base and threadedly engages the threaded recess in the intonation module. Each end of the reverse threaded screw is fashioned with a broche at each end in order to receive a hex wrench.

In the preferred embodiment the "pin hole" is positioned in alignment with the broche so that the attachment screw can be easily accessed through the tuning element for threadably securing bridge elements or intonation modules by a hex wrench dimensioned to fit the broche. The function of the broche could be easily replaced by a slot formed for use with a screw driver instead, for example.

In the preferred embodiment the location of bridge elements and intonation module reverse-thread attachment screws and their related "pin hole" and attachment slot are located off center relative to the axis of the string so that attachment screw can be located extremely close to the second critical point. Positioning the intonation module secured by the attachment screw provides for the adjusting of the harmonic tuning of a string.

Improved Attachment Screw

Another improvement comprises a standardized base plate wherein the elements, such as the various intonation modules, bearing arrangements and the tremolo arm support, otherwise disparate on the two vintage systems, Type I and Type II, and other offerings are the same or universal. The standardized base plate comprises a string spacing in the preferred embodiment of 0.422" which includes bridge elements and intonation modules that are approximately 0.416" wide transverse the direction of the strings so that there is 0.002" clearance between at least one side of the bridge elements and intonation modules for maintaining optimal alignment. In the preferred embodiment, "tiers" approximately 0.422" are provided for variably supporting the second critical point in order to create a string radius that follows the fingerboard radius. Measuring from the upper surface of base plate as a zero reference point of measurement where the $1^{st}$ and $6^{th}$ string bridge elements or intonation modules are located, the "E" string and lower "E" strings, respectively. The "tiers" associated with the $2^{nd}$ and $5^{th}$ string, typically, on the guitar the "B" and "A" string, respectively, are raised approximately 0.029" and the $3^{rd}$ and $4^{th}$ strings, the "G" and "D" strings, respectively, share a common "tier" displaced 0.04". Accordingly, the middle "tier" is 0.844" wide, the outer "tiers" are each 0.422" wide and flanked on each side an area at least 0.422" wide for positioning the remaining bridge elements or intonation modules. Further, a string hole is provided on the base plate portion for alternately threading a string from the spring block or spring blade portion to the bridge elements.

Positioned within each 0.422 space there are associated slots through which the reverse-threaded attachment screws are slideably located. The reverse-threaded screw is threadedly attached to the bridge elements of the intonation modules.

Adaptor Plate

The unitary component or base plate/spring blade combination that is a single piece of bent material is notable for its improved sonic character and other advantages. Another object of the present invention is to provide the best integration of the varied designs in the fulcrum tremolo species and include an adaptor plate such as employed in the above referenced "fine tuner plate". Other similar or varied expressions are possible to accommodate other uses. For example, in the former case, a different adaptor plate could be attached in a similar manner as the "fine tuner plate" to the unitary component but follows a form that replicates the functional design details and spacing of the rearward upward bend of Fender '146 base plate that provides a series of openings, one for each bridge element, through which extends a spring loaded screw, that allows for the pivotal mounting and positioning of each of the Fender-style bridge elements in common use today including those with readably available piezo-electric pickups.

Options

The unitary component also provides additional openings in the spring blade portion that could serve to attach and position acoustic enhancers that could include among others devices such as pickups, tuned free-to-vibrate portions or a mute that would vary the responsiveness of the unitary component.

The various features of novelty which characterize the invention are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

DETAILED DESCRIPTION OF THE INVENTION

Figure 1:
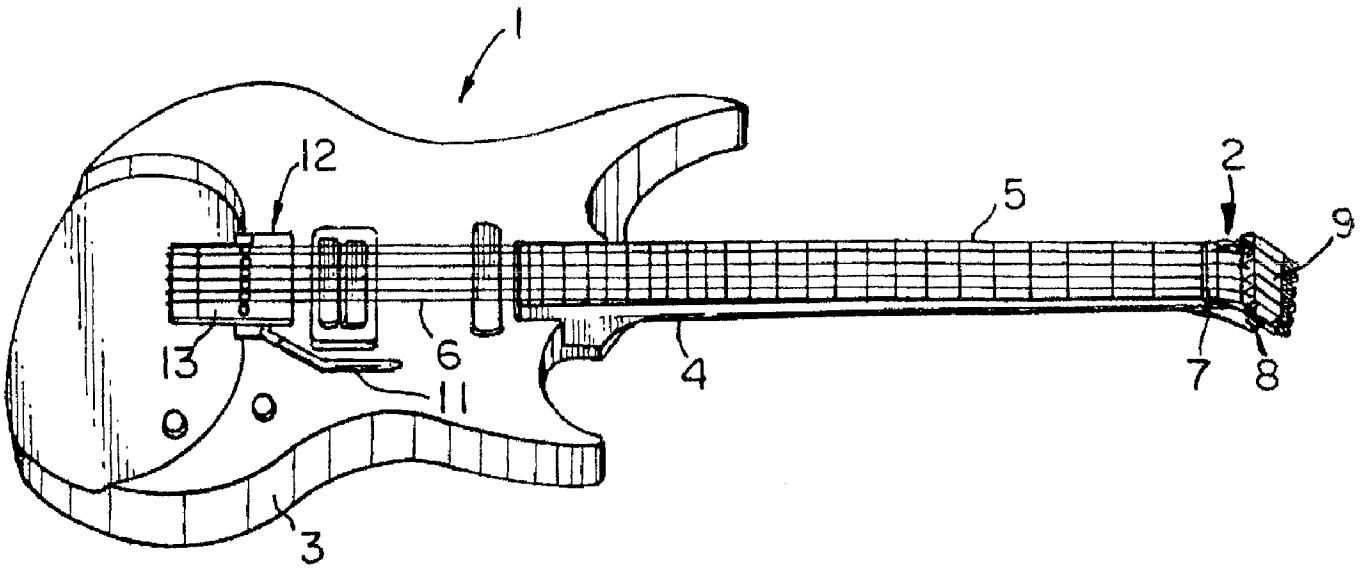
FIG. 1 is a plan view of an electric guitar embodying the present invention.

In FIG. 1, an electric guitar 1 is illustrated comprising a head 2 at one end, a body 3 at the other end, with a neck 4 extending between the head and the body. Six strings 6 extend from head 2 to body 3 over neck 4. Neck 4 forms fret board or fingerboard 5 for guitar 1. At head 2, each string 6 extends over nut 7 forming first critical point 8 for each of strings 6. Nut 7 is located at the transition of neck 4 to head 2. Each string 6 is secured on the head by a corresponding tuner 9. On the body 3, strings 6 are secured to fulcrum tremolo 10. Fulcrum tremolo 10 has arm 11 for pivoting the tremolo and providing the vibrato effect on the strings. Fulcrum tremolo 10 has six intonation modules 12, one for each string 6.

The intonation modules present improvements to the fine-tuning invention incorporating the function of the bridge element and tailpiece in its structure as well as the capacity to adjustably fix one end of the individual strings to the instrument at more than one tailpiece position. The intonation modules are slideably positionable and, thereby, adjust the relative distance between first critical point 8 and second critical point 16 or the harmonic tuning as such.

The invention is shown for us on electric guitar 1 and it should be understood that the invention could be used on a variety of stringed musical instruments.

In body 3 of guitar 1 there are electric pickups shown without numbers.

In the following description, fulcrum tremolo 10 will be described in greater detail. Fulcrum tremolo 10 comprises a second critical point, one for each of strings 6, sometimes characterized as an intonation point, witness point or bridge point.

Figure 2:
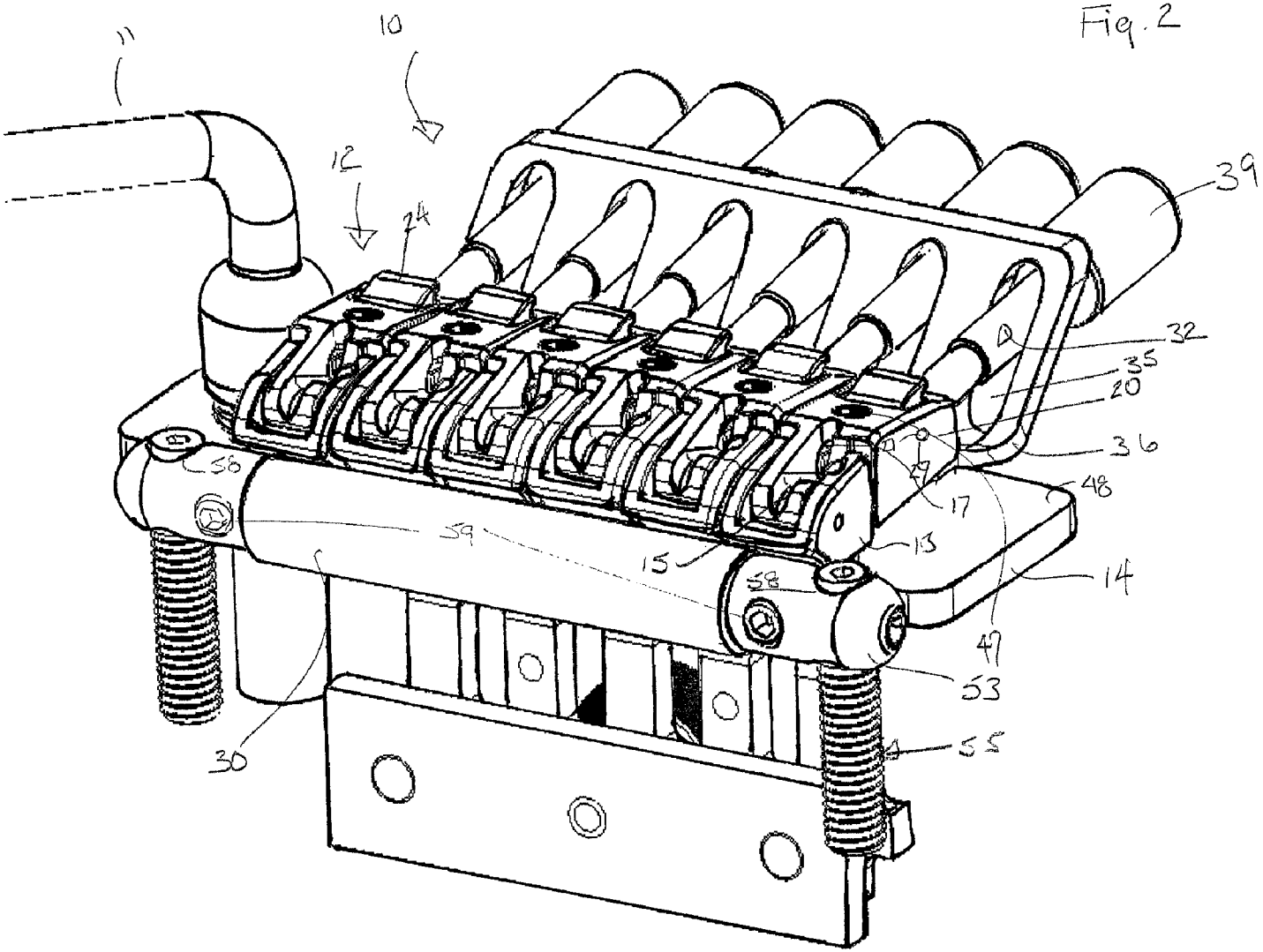
FIG. 2 is a front perspective view of the improved fine-tuners comprising the improved tuning and clamping element, attachment screw and the improved bearing mounting arrangement of the present invention as used in the electric guitar.
Figure 3:
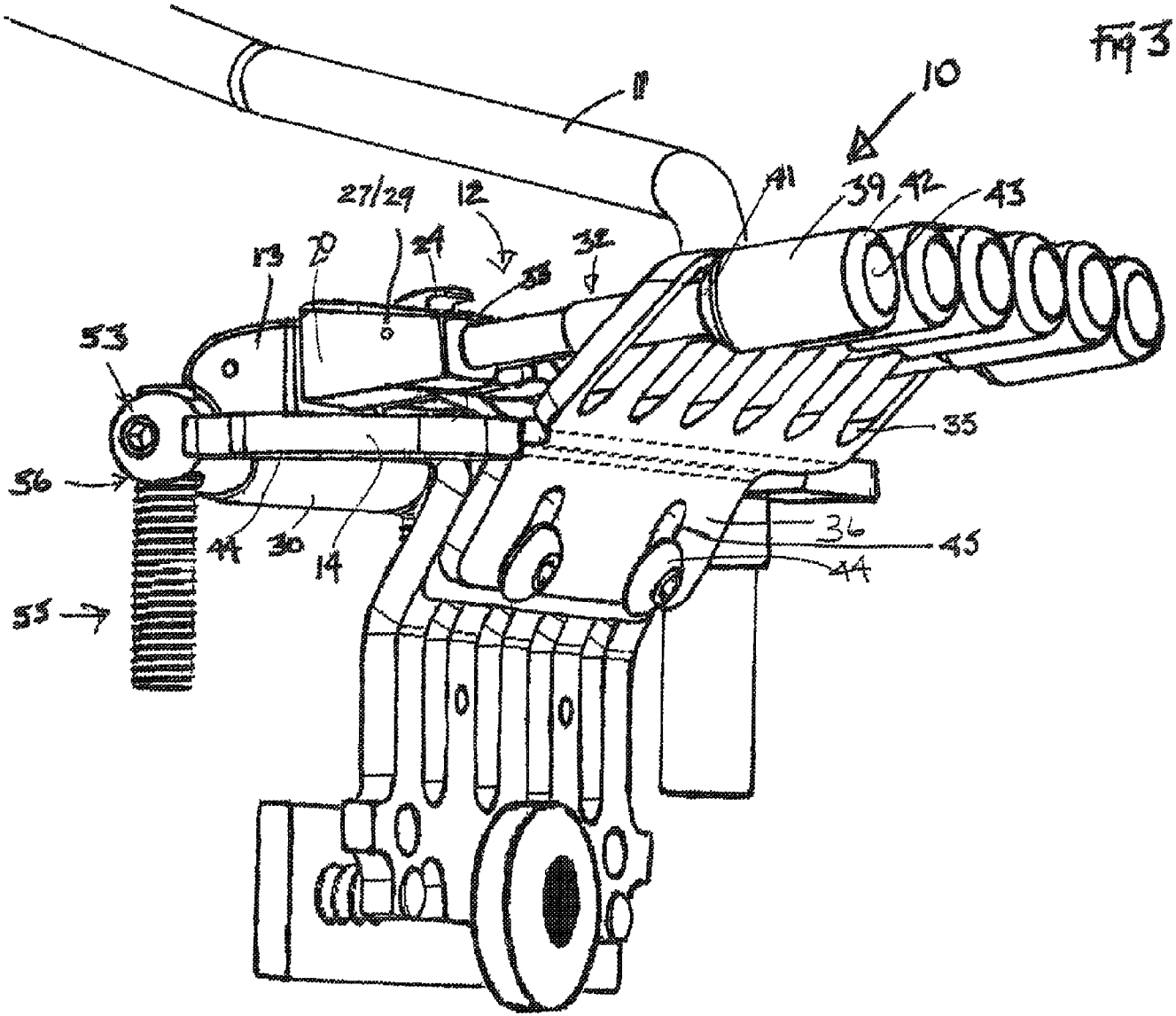
FIG. 3 is a rear perspective view of the improved fine-tuners comprising the improved tuning and clamping element and attachment screw and the adaptor plate arrangement of the present invention as used in the electric guitar.
Figure 4:
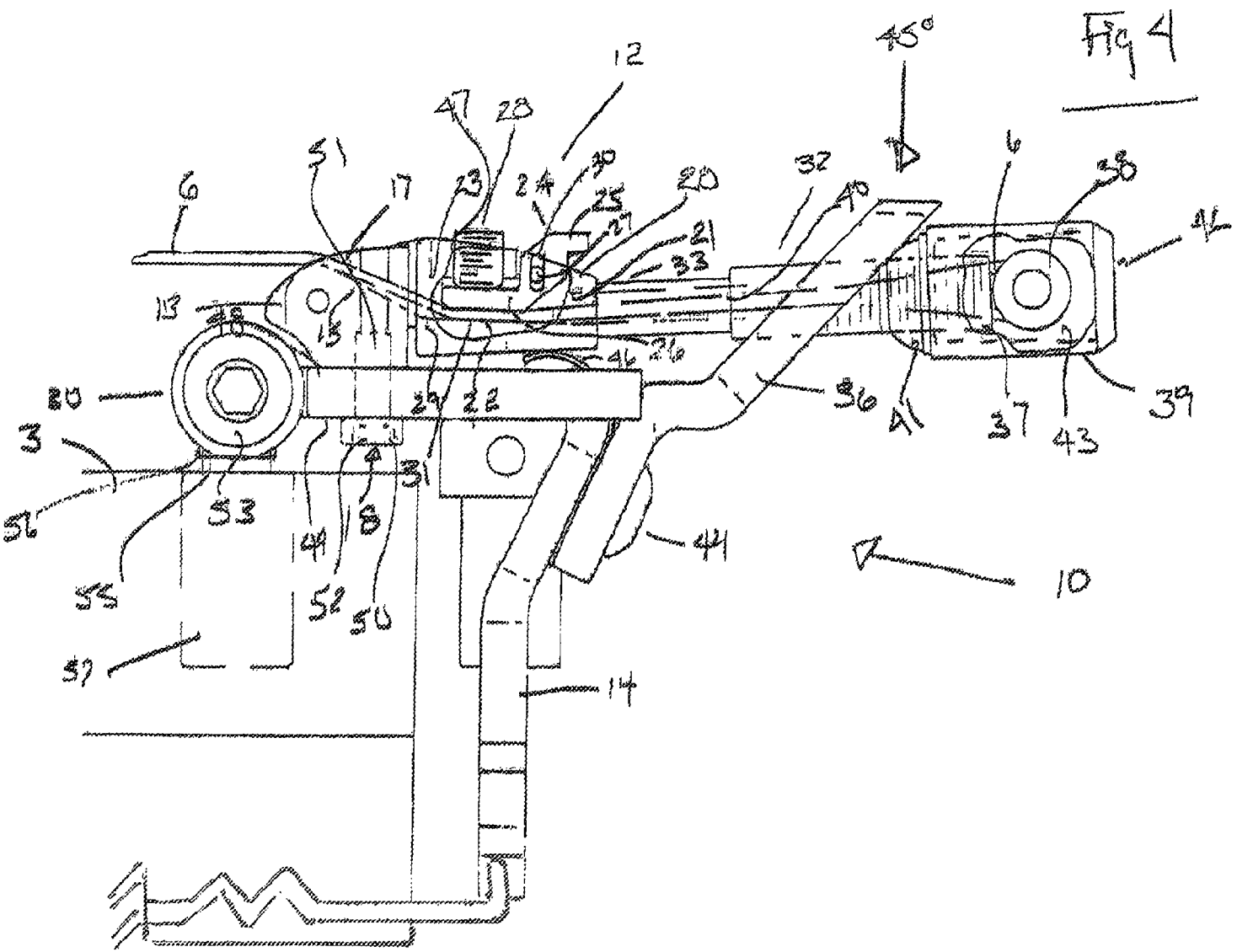
FIG. 4 is a side view cross-section of the tremolo mechanism showing the improved fine-tuners comprising the improved tuning and clamping element and attachment screw and the adaptor plate arrangement.

In FIGS. 2 and 3, fulcrum tremolo 10 is shown on an enlarged scale compared to FIG. 1. FIG. 4 displays fulcrum tremolo 10 of FIGS. 2 and 3 in a cross-section view. Second critical point 16 is located on intonation modules 12 in the area of the string opening 17 closer nut and/or first critical point 8. The leading-edge portion of base plate 14 is also the portion closest to nut 7 and can form bearing housings 30. Bearing housing 30 adjustably supports base plate 14 pivotally relative to body 3.

In FIGS. 2 and 3, the improved fulcrum tremolo is shown with a plurality of intonation module 12 that includes base 13. Base 13 is adjustably secured to base plate 14 of fulcrum tremolo 10 by reverse thread screws 28 through slots 29. Loosing screws 28 permits longitudinal movement of base 13 and associated parts for harmonic tuning of string 6.

There are three independent improvements, an improved fine tuner arrangement, an improved clamping element and an attachment plate comprising a fine tuner plate, which, in the preferred embodiment, work cooperatively together.

Adaptor Plate

One object of the present invention is to provide an improved fine tuning arrangement comprising an adaptor plate or fine tuner plate portion 36 secured to base plate 14 of fulcrum tremolo 10 by attachment screw 44, preferably, in a manner that yields a portion with a 45-degree angle relative to body 3. Six slots 35 further define fine tuner plate portion 36, one each associated with one each of hollow tubes 32 associated with intonation module 12. In the preferred embodiment fine tuner adaptor plate portion 36 is attached to the base plate 14 but could also be formed from the base plate itself. Accordingly, fine tuner adaptor plate portion 36 is further fashioned with two attachment slots 45 through which plate attachment screws 44 extend and threadedly engage threaded openings in base plate 14 which are not illustrated. Threading attachment screws 44 variably secures fine tuner plate 36 to base plate 14.

Fine Tuner Element

Separate string holder 34 comprises hollow tube 32. First end 33 of hollow tube 32 is connected to the separate string holder element 34 and extends through a respective slot 35 in the adaptor plate 36. Hollow tube 32 second end 37 forms a portion for fixedly receiving the ball end 38 of string 6. Hollow tube 32 runs essentially in the direction of string 6. Hollow tube second end 37 is formed additionally to threadedly receive fine tuner knob 39.

String 6 of the musical instrument 1 makes critical contact with base 13 of intonation module 12 adjacent the string opening 17 and continues through string passageway 15 sloping downwardly and rearwardly through base 13 into enlarged recess 21. String 6 continues through string passageway 40 of hollow tube 32 and the ball end of string 6 being fixedly secured at hollow tube second end 37 is pivotally positioned within adaptor plate 36 slot 35. Pivotally positioning hollow tube 32 and, therefore string 6, varies the tension of string 6.

Fine tuner knob first end 41 comprises a curved surface suitably formed to make variable bearing contact with adaptor plate 36. Fine tuner knob second end 42 comprises an enlarged interior portion 43 sufficient in proportions to avoid contacting the ball end of string 6 fixed to hollow tube second end 37 when fine tuner knob 39 is threadedly positioned. Threading fine tuner knob 39 variably positions the fine tuner knob first end 41 against the angled adaptor plate 36 and, thereby, variably displaces the position of hollow tube 32 and fine tuner knob 39 providing an adjustment whereby tension or pull on string 6 is applied sufficient measure to make an adjustment to the tension of string 6 within a range that is typically less than the interval of a minor third, otherwise, known as fine tuning. Since fine tuner knob 39 moves on hollow tube 32 in the direction of the strings, when the position of fine tuner knob 39 is closest to the bridge element portion of base 13 in the direction of hollow tube 32, the tension is increased and, conversely, when fine tuner knob 39 is furthest from the bridge element in the direction of hollow tube 32 the tension is decreased. Spring 46 having a first portion positioned between base plate 14 and adaptor plate 36 includes a second portion positioned between separate string holder 34 and base plate 14 tends to position hollow tube 33 away from body 3.

The mechanism that provided the fine tuners in the preferred embodiment could also take on the qualities of a macro-tuner; for example, releasable latches at the upper portion of slot 35 of adaptor plate 36 could extend the range of pivoting of hollow tube 32 sufficient to provide the additional force to bring an untensioned string, otherwise secured to the instrument near or at the nut, to proper playing pitch and provide for the requisite adjustments.

Clamping Element

Clamping element 20 comprises an enlarged recess 21 forming a smooth transition extending in the direction of string 6 within base 13 from passageway 15 through to hollow tube portion 32 in the preferred embodiment although no hollow tube portion 32 is required. Enlarged recess 21 has lower surface 22 and upper surface 23. Clamping lever 24, having an L-shape or profile comprising an upper leg 25 and a lower leg 26, clamping lever securing pin 27 and clamping adjustment screw 28 are connected to enlarged recess 21.

Enlarged recess 21 further comprises an oversized opening 30 for receiving clamping lever 24. Clamping element 20 further comprises at least one pin hole 29 positioned adjacent oversized opening 30 transverse the direction of string 6 for receiving clamping lever 24 securing pin 27. Clamping lever 24 is positioned within enlarged recess 21 and oversized opening 30 so that lower leg 26 is in the direction of string 6 and upper leg 25 is transverse the direction of string 6. String 6 extends between lower surface 22 and lower leg 26.

Clamping adjustment screw 28 is threadedly positioned relative to lower leg 26 transverse the direction of string 6. Threading clamping adjustment screw 28 in one direction is operable to make bearing contact with lower leg 26 and position lower leg 26 relative to lower portion 22 to clamp string 6 between lower leg 26 and lower portion 22 and threadable in the opposite direction to release clamping lever 24 and string 6. Upper leg 25 of clamping lever 24 is manually operatable to position lower leg 26 for release of string 6 when clamping adjustment screw 28 is positioned away from lower leg 26

In the preferred embodiment that combines the clamping element 20 with the fine tuning element, threading clamping adjustment screw 28 positions lower leg portion 26 of clamping lever 24 against string 6 to create a clamping point 31 in order to fixedly secure string 6 and thereby transfer the fixing of string 6 from the hollow tube second end 37 to the clamping point 31 between lower leg 26 and lower surface 22 and render the string inextensible between clamping point 16 and hollow tube second end 37.

Improved Attachment Element

The improved attachment comprises base 13 further comprising reverse threaded attachment opening 47, reverse-threaded screw 18 connected to base 13 and base plate slots 19 extending in the direction of string 6, one for each base 13 of intonation module 12. Base plate 14 has upper surface 48 furthest from body 3 and lower surface 49 closer body 3. Reverse-threaded screw 18 comprises head portion 50 and threaded portion 51; head portion 50 and threaded portion 51 each comprise recess 52 formed to receive a separate adjustment tool.

Reverse-threaded screw 18 formed with head portion 50 is slideably positioned against base plate 14 lower surface 49. Threaded portion 51 extends through slot 19 of base plate 14 to engage base 13 reverse threaded attachment opening 47. Threading reverse-threaded screw 18 draws base 13 to upper surface 48 for adjustably clamping base 13 of intonation module 10 to base plate 14 relative to first critical point 8 for determining harmonic tuning.

Access to recess 52 is provided through base 13 reverse threaded attachment opening 47, whereby inserting an adjustment tool through reverse threaded attachment opening 47 engages reverse-threaded screw 18 for securing intonation module 12 to base plate 14.

Bearing Housing Transverse Set Screw

Figure 5:
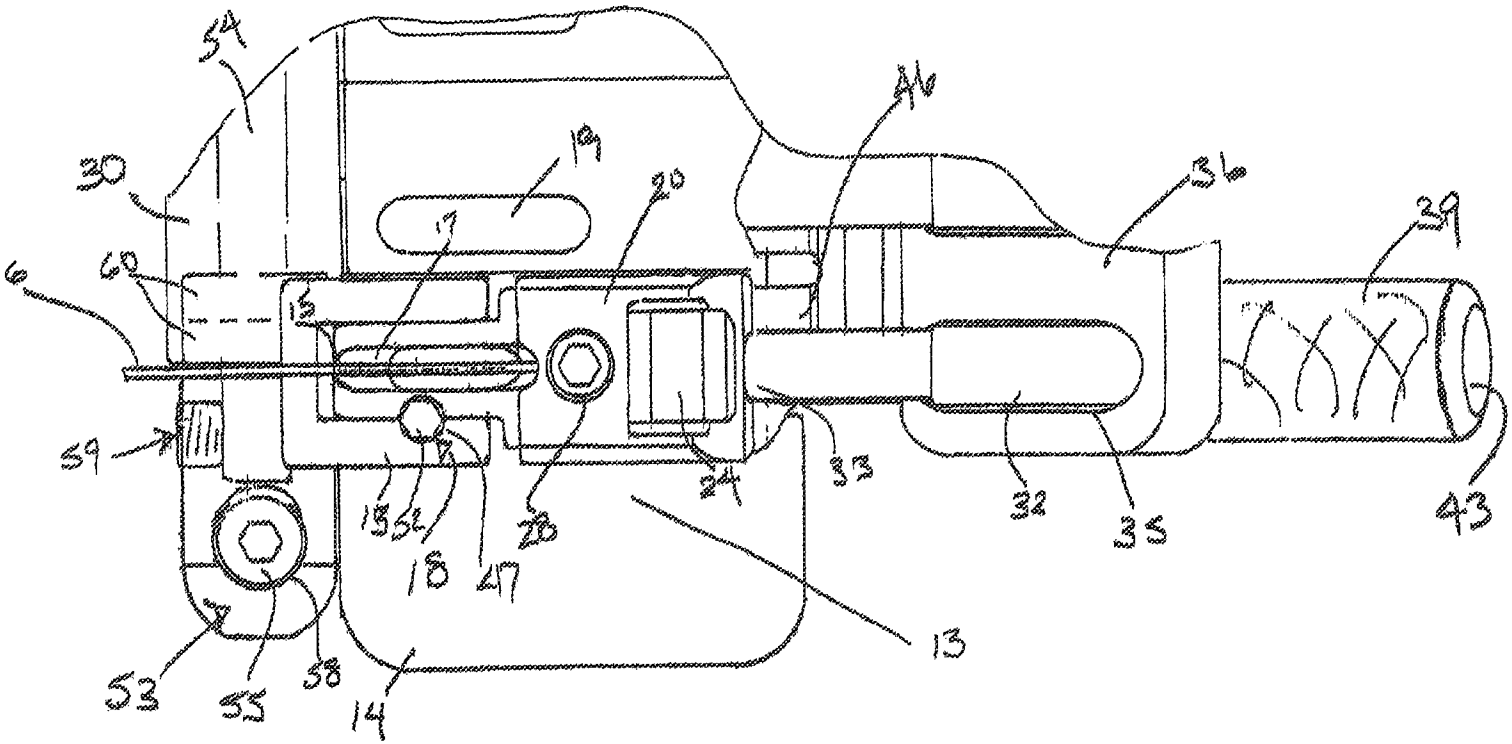
FIG. 5 is a top view of the tremolo mechanism showing the improved fine-tuners comprising the improved tuning and clamping elements, the adaptor plate arrangement as well as the reverse threaded attachment screw opening in the intonation module and the bearing housing alignment set-screw improvement.

FIG. 5 shows improved fulcrum tremolo 10 comprising base plate 14, intonation module 12 extending in the direction of string 6 and a bearing arrangement. The bearing arrangement further comprises bearing housing 59, bearings 60 and bearing axel housing 53 connected to axel 54. Bearings 60, bearing axel 54, bearing axel housing 53 and bearing housing 59 and, therefore, base plate 14 and the rest of the fulcrum tremolo apparati are adjustably supported relative to body 3 of the instrument. Riser post 55 further comprises annular flange 56 variably supporting bearing axel housing 53. Riser post 55 is threadedly connected to body 3 insert 58. By threading post 55 into insert 57, the spacing between body 3 and housing 53 is selectively adjustable. Adjustment of post 55 is effected through an oval opening 58 in the top of housing 30. Set-screw 59 seen transverse bearing axle 54 is threadedly positioned within bearing axel housing 53 for additionally securing bearing axle 54 within bearing axle housing 53.

By manipulating tremolo arm 11, the entire fulcrum tremolo 10, except the bearing axel housings, riser posts and inserts, can be pivoted about axel 54 to achieve the desired tremolo effect.

The various features of novelty which characterize the invention and are intended to contribute to the upward spiral of Light are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

The invention claimed is:

1. An apparatus for a stringed musical instrument, the stringed musical instrument comprising a body and a neck, a plurality of strings extending from the body to the neck, a nut for supporting the strings on the neck forming a first critical point for each string, a bridge element for supporting the strings on the body forming a second critical point for each string, the apparatus comprising:

a base comprising:
- a first side furthest from the body,
- a second side closer to the body, a tailpiece, a string clamping element connected to the base comprising:
- a forward end closer to the nut, and
- a rearward end further from the nut;
- an enlarged recess to receive at least one string therethrough, the enlarged recess comprising:
  - a lower surface generally parallel to the strings extending between the first critical point and the second critical point and closer to the first side; and
  - an upper surface generally parallel to the string extending between the first critical point and the second critical point and further from the first side;

a clamping portion variably connected to the string clamping element comprising:
- a first surface extending generally parallel to the strings extending between the first critical point and the second critical point closer to the upper surface of the enlarged recess; and
- a second surface extending generally parallel to the strings extending between the first critical point and the second critical point closer to the lower surface of the enlarged recess; and a clamping screw transverse the direction of the strings threadedly connected to the string clamping element in variable contact with the first surface of the clamping portion;

wherein threading the clamping screw is operable to position the first second surface of the clamping portion relative to the lower surface of the elongated recess to secure a string, wherein the clamping element further comprises an additional opening extending through the upper surface of the enlarged recess, the clamping portion further comprises an L-shaped form comprising an upper leg extending away from a lower leg transverse the direction of the strings through the additional opening, the lower leg comprising the first and second surface;

wherein the upper leg is operable to manipulate a position of the clamping portion.

2. Apparatus of claim 1 wherein the tailpiece comprises a first tailpiece located on an opposite side of the string clamping element from the first critical point to secure a string;

wherein threading the clamping screw to position the second surface of the clamping portion relative to the lower surface of the enlarged recess to secure a string forms a second tailpiece and is operable to render the string inextensible between the first and second tailpiece.

3. Apparatus of claim 2 wherein the second tailpiece comprises an elongated portion connected to the string clamping element extending in a direction opposite to the nut.

4. Apparatus of claim 3 wherein the elongated portion further comprises a hollow tube fashioned to receive a string therethrough, the hollow tube comprising:

a first end closer to the string clamping element; and a second end located further from the string clamping element, wherein the second end comprises the first tailpiece.

5. Apparatus of claim 4 further comprises a tremolo wherein the bridge element is connected to the base and is located between the forward end and the clamping element.

6. Apparatus of claim 4 further comprises a fulcrum tremolo wherein the bridge element is connected to the base and is located between the forward end and the clamping element.

7. A fulcrum tremolo for a stringed musical instrument, the stringed musical instrument comprising a body and a neck, a plurality of strings extending from the body to the neck, a nut for supporting the strings on the neck forming a first critical point for each string, the fulcrum tremolo comprises:

a base plate, the base plate further comprising:

a first surface closer to the body, and a second surface further from the body;

at least one attachment screw comprising:

a head, and a threaded portion slideably connected to the base plate;

an end of the threaded portion furthest from the head;

at least one intonation module comprising:

a second critical point, an upper surface closer to the second critical point, a lower surface closer to the base plate, and a threaded opening extending from the upper surface to the lower surface transverse the strings to receive the at least one attachment screw;

the base plate further comprising at least one slot-like opening extending through the base plate formed to extend in the direction of the strings to receive the at least one attachment screw therethrough;

the threaded portion of the at least one attachment screw and the threaded opening of the at least one intonation module are reverse-threaded, the head of the at least one attachment screw is positioned on the second surface of the base plate, the reverse-threaded portion extends through the at least one slot-like opening and threadedly engages the reverse-threaded opening, whereby threading the at least one attachment screw is operable to slideably secure the second critical point relative to the first critical point, wherein the end of the threaded portion furthest the head has a first recess, wherein the first recess comprises a broche.

8. Apparatus of claim 7 wherein the head comprises a second recess.

9. Apparatus of claim 8 wherein the second recess comprises a broche.

10. Apparatus for a stringed musical instrument, the stringed musical instrument comprising a body and a neck, a plurality of strings extending from the body to the neck, each of the plurality of strings further comprising a ball end, a nut for supporting the strings on the neck forming a first critical point for each string wherein the apparatus comprises:

a fulcrum tremolo further comprising:

a base plate, and an intonation module comprising:

a base connected to the base plate, the base further comprising:

a first side furthest from the body, and a second side closer to the body;

a fine tuning element pivotally connected to the base to tension a string comprising:

a forward end closer to the nut, a rearward end further from the nut, an enlarged recess formed to receive a string therethrough, the enlarged recess further comprising:

a lower surface extending generally parallel to the strings extending between the first critical point and a second critical point closer to the first side; and an upper surface extending generally parallel to the strings extending between the first critical point and a second critical points further from the first side;

a bridge element connected to the tuning element located closer the forward end forming a second critical point;

a hollow tube located on the opposite side of the bridge element from the nut comprising:

a string passageway to receive a string therethrough, a first end closer to the bridge element, and a second end located further from the bridge element, the second end comprising a tailpiece to secure a ball end of a string;

an adaptor plate, the adaptor plate comprising a fine tuner plate connected to the fine tuning element, wherein the adaptor plate is transverse to the direction of strings on an opposite side of the second critical point from the first critical point and extending generally away from both the first critical point and the body an angle relative to the direction of the strings, an adapter plate further comprising at least one slot formed to receive at least one hollow tube therethrough, a first surface closer to the bridge element, and a second surface further from the bridge element;

wherein the intonation module further comprises a fine tuner knob threadedly connected to the hollow tube, wherein the hollow tube, the fine tuner knob and the tailpiece are located on an opposite side of the second critical point from the first critical point;

wherein threading the fine tuner knob is operable to pivotally position the fine tuning element to change the tension of a string; and wherein the intonation module further comprises:

a string clamping element connected to the tuning element, the string clamping element having a forward end closer to the nut, and a rearward end further from the nut;

a clamping portion variably connected to the string clamping element having a first surface generally parallel to the strings extending between the first critical point and the second critical point closer to the upper surface of the enlarged recess; and a second surface generally parallel to the strings extending between the first and second critical points closer to the lower surface of the enlarged recess; and a clamping screw transverse the direction of the strings threadedly connected to the string clamping element in variable contact with the first surface of the clamping portion, wherein threading the clamping screw is operable to position the second surface of the clamping portion relative to the lower surface of the enlarged recess to secure a string.

11. Apparatus of claim 10 wherein the tailpiece comprises:

a first tailpiece to secure a string, wherein the first tailpiece comprises the string clamping element; and wherein threading the clamping screw to position the second surface of the clamping portion relative to the lower surface of the enlarged recess to secure a string forms a second tailpiece and is operable to render the string inextensible between the first and second tailpiece.

12. Apparatus of claim 11 wherein the fine tuner knob comprises:

a first end and a second end;

the second end comprises a recess larger than both the second end of the hollow tube and the ball end of a string; and a bearing surface.

13. Apparatus of claim 10 wherein the base plate comprises unitary component that is a single piece of bent material comprising: a forward edge, a portion of the forward edge being a pivot and forming a pivot axis, and an end opposite of the forward edge; the opposite end of the forward edge of the base plate comprising: a bend in the unitary component; a transverse portion comprising: at least one spring socket to receive an end of at least on biasing element; and wherein the bend transitions the base plate to the transverse portion, and wherein the bend and the transverse portion are approximately parallel to the pivot axis.

14. A fulcrum tremolo for a stringed musical instrument, the stringed musical instrument comprising a body and a neck, a plurality of strings extending from the body to the neck, a nut for supporting the strings on the neck forming a first critical point for each string, the fulcrum tremolo further comprising:

a base plate being approximately planar:

the base plate further comprising:

a first surface closer to the body, a second surface further from the body, and at least one slot opening;

at least one portion connected to the base plate formed to receive at least one bearing assembly forming a pivot axis for the fulcrum tremolo; the at least one bearing assembly, comprising:

at least a portion of a shaft transverse the direction of the plurality of strings aligned to the pivot axis, at least one mounting element comprising a shaped recess, at least a portion of a ball bearing surface, and at least one setscrew threadably attached to the at least one mounting element transverse to the direction of the pivot axis wherein threading the at least one setscrew positions the at least a portion of a shaft; and at least one attachment screw comprising:

a head and a reverse threaded portion slideably connected to the base plate, the head of the at least one attachment screw is connected to the second surface of the base plate;

at least one intonation module further comprising:

a second critical point, a base connected to the base plate; the base comprising:

an upper surface closer to the second critical point, a lower surface closer to the base plate, and a reverse-threaded opening extending from the upper surface to the lower surface transverse the direction of the strings;

wherein the at least one slot opening is formed to allow the at least one attachment screw therethrough whereby threading the at least one attachment screw is operable to slideably secure the at least one intonation module and thereby the second critical point relative to the first critical point; and a fine tuning element pivotally connected to the base to tension a string comprising:

a forward end closer to the nut, a rearward end further to the nut, an enlarged recess formed to receive a string therethrough, the elongated recess further comprising:

a lower surface generally parallel to the strings extending between the first critical point and the second critical point and closer to the base plate, and an upper surface generally parallel the strings extending between the first critical point and the second critical point and further from the base plate;

a bridge element connected to the fine tuning element located closer to the forward end forming a second critical point;

an elongated portion located on an opposite side of the bridge element from the nut and extending in a direction opposite to the nut, the elongated portion further comprising:

a first end closer to the bridge element and a second end located further from the bridge element, the second end comprising a tailpiece to secure a ball end of a string, an adaptor plate, the adaptor plate comprising a fine tuner plate located transverse the direction of the strings on an opposite side of the second critical point from the first critical point and extending generally away from both the first critical point and the body at an angle relative to the direction of the strings; the adaptor plate comprising:

at least one slot formed to receive at least one elongated portion therethrough;

a first surface closer to the bridge element and a second surface further from the bridge element;

a fine tuner knob, the fine tuner knob threadedly connected to the second end of the elongated portion; wherein the fine tuner knob is positioned on an opposite side of the fine tuner plate from the bridge element, and the fine tuner knob is in variable bearing contact with the second surface of the angled fine tuner plate, and the elongated portion, the fine tuner knob and the tailpiece are located on the opposite side of the second critical point from the first critical point, wherein threading the fine tuner knob is operable to pivotally position the tuning element to change the tension of a string; and a string clamping element connected to the tuning element comprising:

a forward end closer to the nut, and a rearward end further from the nut;

a clamping portion variably connected to the string clamping element comprising:

a first surface generally parallel to the strings extending between the first critical point and the second critical point closer to the upper surface of the enlarged recess;

a second surface generally parallel to the strings extending between the first critical point and the second critical point closer to the lower surface of the enlarged recess; and a clamping screw transverse the direction of the strings threadedly connected to the string clamping element in variable contact with the first surface of the clamping portion;

wherein threading the clamping screw is operable to position the first surface of the clamping portion relative to the lower surface of the enlarged recess to secure a string.

15. Apparatus of claim 14 wherein the at least one mounting element comprises a bearing housing.

16. Apparatus of claim 14 wherein the at least one mounting element comprises an axel housing.

* * * * *